US009500081B2

(12) United States Patent
Koenig et al.

(10) Patent No.: US 9,500,081 B2
(45) Date of Patent: Nov. 22, 2016

(54) TURBINE WHEEL AND METHOD FOR THE PRODUCTION THEREOF

(75) Inventors: Igor Koenig, Frankenthal (DE); Georg Scholz, Woellstein (DE)

(73) Assignee: BorgWarner Inc., Auburn Hills, MI (US)

( * ) Notice: Subject to any disclaimer, the term of this patent is extended or adjusted under 35 U.S.C. 154(b) by 682 days.

(21) Appl. No.: 13/577,097

(22) PCT Filed: Feb. 7, 2011

(86) PCT No.: PCT/US2011/023868

§ 371 (c)(1),
(2), (4) Date: Aug. 3, 2012

(87) PCT Pub. No.: WO2011/102984

PCT Pub. Date: Aug. 25, 2011

(65) Prior Publication Data

US 2012/0315149 A1 Dec. 13, 2012

(30) Foreign Application Priority Data

Feb. 19, 2010 (DE) ..... 10 2010 008 555

(51) Int. Cl.
*F01D 5/02* (2006.01)
*F01D 5/04* (2006.01)
*B22C 9/04* (2006.01)

(52) U.S. Cl.
CPC . *F01D 5/02* (2013.01); *B22C 9/04* (2013.01); *F01D 5/04* (2013.01); *F05D 2220/40* (2013.01); *F05D 2230/21* (2013.01); *F05D 2230/211* (2013.01); *Y10T 29/4932* (2015.01)

(58) Field of Classification Search
CPC ..... F02B 39/00; B21D 53/78; F01D 5/32; F01D 5/30; F01D 5/025; F01D 5/026; B24B 1/00; F05D 2220/40; F04D 29/266; F04D 29/284; F16D 1/068; Y10T 29/4932
See application file for complete search history.

(56) References Cited

U.S. PATENT DOCUMENTS 4,240,678 A * 12/1980 Sarle et al. ..... 384/369
4,273,512 A * 6/1981 Weiler ..... 416/188
4,519,747 A * 5/1985 Yamazaki ..... F01D 5/025 29/432
4,761,117 A * 8/1988 Oda ..... C04B 37/021 416/241 B
4,798,320 A * 1/1989 Fang ..... 228/124.7
7,001,155 B2 * 2/2006 Cabrales ..... F01D 5/025 415/170.1
7,287,960 B2 * 10/2007 Decker ..... F01D 5/025 416/213 R
2001/0027963 A1 * 10/2001 Bazukuri ..... F01D 5/025 219/121.14
2005/0036893 A1 * 2/2005 Decker ..... B22F 5/04 416/244 A
2005/0188694 A1 * 9/2005 Frankenstein ..... F01D 25/183 60/602
2006/0021221 A1 * 2/2006 Decker ..... F01D 5/025 29/889.61
2008/0193296 A1 * 8/2008 Takeda ..... F01D 5/048 416/223 A
2010/0003132 A1 * 1/2010 Holzschuh ..... F01D 5/025 415/230
2010/0068053 A1 * 3/2010 Mathieu ..... F01D 25/166 415/229
2011/0091324 A1 * 4/2011 Holzschuh ..... 416/200 A
2012/0183406 A1 * 7/2012 Yoshida ..... F01D 5/048 416/219 R
2012/0189373 A1 * 7/2012 Lange ..... F01D 5/025 403/1

* cited by examiner

*Primary Examiner* — Igor Kershteyn
*Assistant Examiner* — Eldon Brockman
(74) *Attorney, Agent, or Firm* — A. Michael Tucker; Stephan A. Pendorf; Patent Central LLC

(57) ABSTRACT

The invention relates to a turbine wheel (1) composed of a turbine wheel blank (2), having a turbine wheel back (3) and having a weld peg (Z) which is arranged on the turbine wheel back (3) via a transition region (5) provided with an undercut (4), wherein the undercut (4) is already provided in the turbine wheel blank (2).

6 Claims, 2 Drawing Sheets

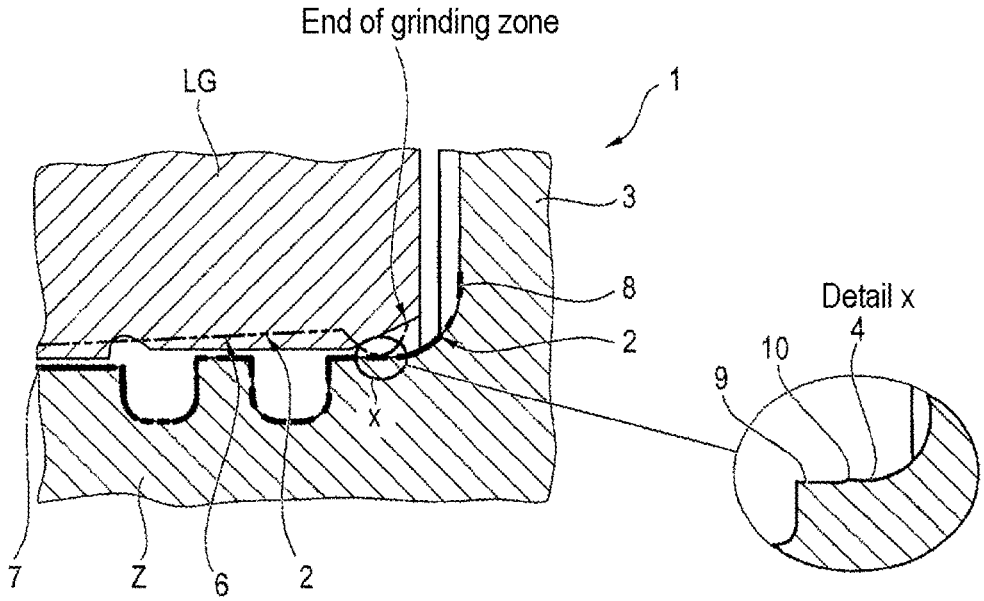
FIG. 1A
FIG. 1B
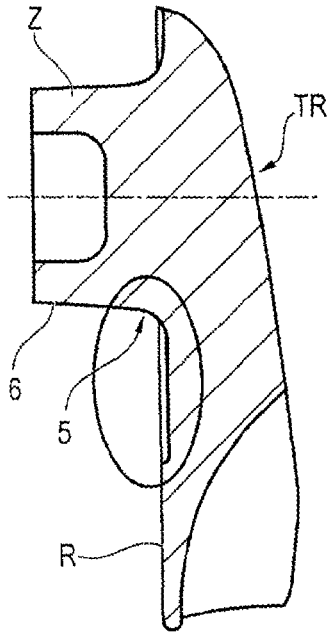
FIG. 3
(Prior art)
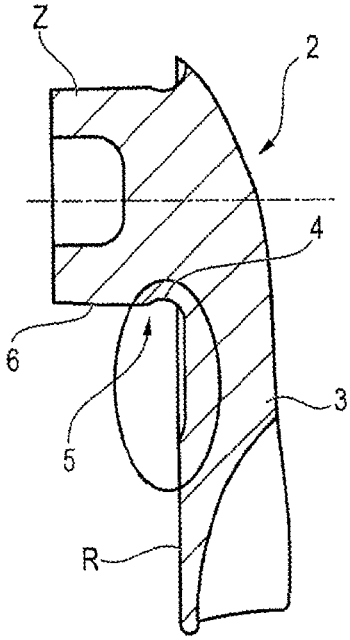
FIG. 2

TURBINE WHEEL AND METHOD FOR THE PRODUCTION THEREOF

BACKGROUND OF THE INVENTION

Field of the Invention

The invention relates to a turbine wheel and to a method for the production thereof, Description of the Related Art The so-called rotor of a turbocharger has a turbine wheel and the turbocharger shaft which can be connected to the turbine wheel via a weld peg arranged on the back of the turbine wheel. For said connection, it is possible for the shaft and the turbine wheel to be connected to one another using a welding process (for example friction welding or electron beam welding). A turbine wheel TR for such a welding process is illustrated in highly simplified schematic form in FIGS. 4 and 5. The turbine wheel TR has the said wheel back R and a weld peg Z which, after the casting process, is mechanically machined along the dash-dotted line SZ with two recesses for piston rings. The vertical region of the dash-dotted line SZ constitutes the end of the grinding zone. Furthermore, according to FIG. 5, an undercut FS is produced at the transition between the wheel back R and the weld peg in a further machining step, which undercut can be seen from FIG. 5.

FIG. 6 shows, by way of example, an embodiment of a turbine wheel TR which again has a wheel back R and a weld peg Z which can be connected by means of a welding process to the shaft not shown in FIG. 6 (or in FIGS. 4 and 5) of the turbocharger. Out of principle, in the case of said rotor, the additional machining for producing an undercut as shown in FIG. 5 should no longer be necessary. However, tests carried out within the context of the invention have shown that a corner E is formed at the transition between the grinding zone and the non-machined part of the turbine wheel because the grinding disk must maintain a distance from the wheel back R, which can in turn lead to a collision between the rotor and the bearing housing LG.

It is therefore an object of the present invention to provide a turbine wheel and to a method for the production thereof, wherein it should be possible to avoid an additional machining step for creating an undercut in the transition region between the weld peg and the wheel back of the turbine wheel.

BRIEF SUMMARY OF THE INVENTION

The invention achieves the stated object in a surprisingly simple manner in that, by means of a suitable casting process, the undercut can be provided already in the turbine wheel blank, such that after the casting process, only that region of the weld peg which up to the transition region, which is already provided with the undercut in any case, of the turbine wheel blank need be mechanically machined. Consequently, in contrast to the prior art, a further machining step is eliminated. Furthermore, after the casting process, that region of the weld peg which is machined for example by means of a grinding disk forms a continuous transition region with the undercut which is integrated during the casting process, which continuous transition region has a positive effect on the strength of the rotor composed of turbine wheel and rotor shaft.

The subclaims relate to advantageous refinements of the invention.

BRIEF DESCRIPTION OF THE SEVERAL VIEWS OF THE DRAWINGS

Further details, features and advantages of the invention will emerge from the following description of exemplary embodiments on the basis of the drawing, in which:

FIG. 1A shows a schematically highly simplified illustration of a turbine wheel according to the invention in a bearing housing, with the form of the pre-machined blank in dash lines, FIG. 1B shows the area detail X, encircled by an oval in FIG. 1A, without the bearing housing illustration, FIG. 2 shows an illustration of a turbine wheel blank, FIG. 3 shows an illustration, corresponding to FIG. 2, of a turbine wheel blank according to the prior art.

DETAILED DESCRIPTION OF THE INVENTION

FIG. 1 shows a schematically highly simplified illustration of a turbine wheel 1 according to the invention, which turbine wheel has a wheel back 3 and a weld peg Z integrally formed on the wheel back 3. Here, the contour illustrated with the dashed line by the double arrow 2 indicates the turbine wheel blank which can be produced by means of a casting process, for example a precision casting process.

Figure 6:
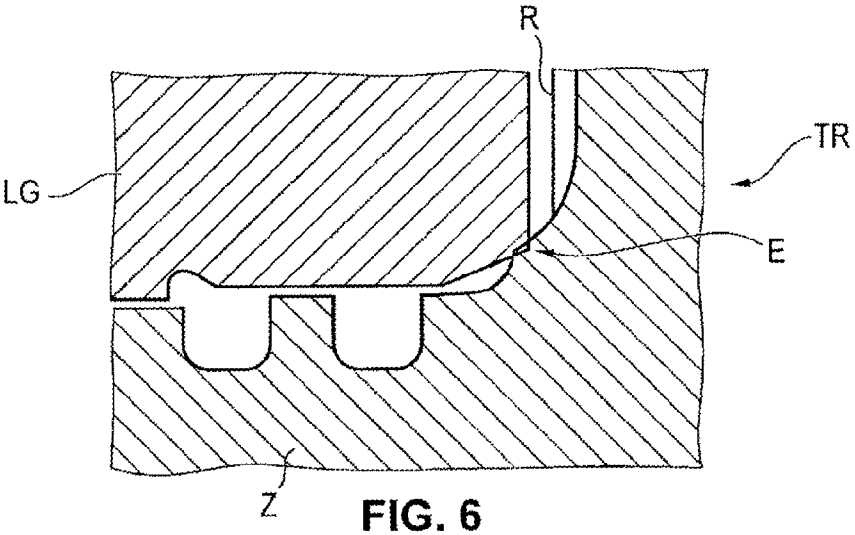
FIG. 6 (Prior art)

After the casting of the turbine wheel blank 2, the latter is machined as far as the arrow "End of grinding zone", wherein that region 6 of the dashed line which extends as far as the arrow "End of grinding zone" is removed for example by means of a grinding process, so as to yield a contour of the points 7 and 8 of the line visible in FIG. 1A for the finished turbine wheel 1, which in the example comprises two grooves for holding piston rings (not illustrated in any more detail in FIG. 1A). As can be seen from FIG. 1A, a collision with the bearing housing LG, as explained on the basis of FIG. 6, can therefore no longer occur. Here, the detail X according to FIG. 1B shows, after the machining by removal of the dashed line 6, a cylindrical region 9, a slight elevation 10 which adjoins said cylindrical region 9, and the undercut 4 which, on account of the removal of the region 6 from the turbine wheel blank 2, lies only a short distance below the region 9 and is therefore at a slightly shorter distance from the central axis.

The undercut in the transition region 5 can accordingly be seen more clearly from FIG. 2, which shows the blank 2 before the machining of the region 6. Because the region 6 has not yet been removed here, the undercut 4 in the transition region is more pronounced.

Figure 5:
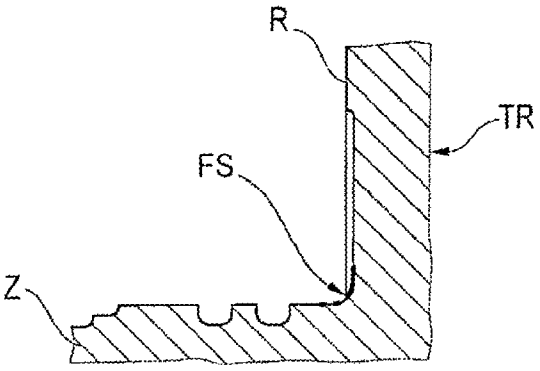
FIG. 5 (Prior art)
FIGS. 4 to 6 show drawings relating to the prior art recognized in the introductory part of the description.
Figure 4:
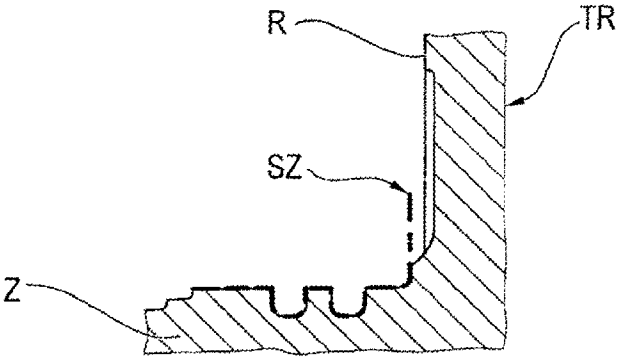
FIG. 4 (Prior art)

The design of the undercut 4 is even clearer in comparison with the prior art, which is illustrated once again in FIG. 3 for the purpose of comparison. From said illustration, it is clear that the transition region 5 has no undercut proceeding from the region 6 to subsequently be machined, such that machining as explained on the basis of FIGS. 4 and 5 is necessary in this case.

Accordingly, the method according to the invention for producing a turbine wheel 1 is restricted to the casting of the turbine wheel blank 2 which is provided with the weld peg Z and the turbine wheel back 3, with the above-explained undercut 4 being produced in the transition region 5 during the casting of the turbine wheel blank 2.

Accordingly, only the above-explained region 6 need be machined after the casting in order to produce the finished turbine wheel 1 from the blank 2.

In addition to the above written disclosure, to complete the latter, reference is hereby explicitly made to FIGS. 1A, 1B and 2.

LIST OF REFERENCE SYMBOLS

1 Turbine wheel
2 Turbine wheel blank
3 Turbine wheel back
4 Undercut
5 Transition region
6 Region to be removed
7, 8 Ends of the finished turbine wheel contour
9 Cylindrical region
10 Elevation
TR Turbine wheel
R Wheel back
Z Weld peg
SZ Grinding zone
FS Undercut machining
LG Bearing housing

The invention claimed is:

1. A turbine wheel blank (2) for machining to form a turbine wheel, the turbine wheel blank (2) having:
- a turbine wheel back (3); and
- a cup-shaped weld peg (Z) which is arranged on the turbine wheel back (3), the cup-shaped weld peg having
  - a cylindrical outer surface having an outer diameter,
  - an axial end face for mating to an axial end face of a shaft,
  - a smooth-walled cylindrical axial recess, and
  - a transition region (5) of radially reduced outer diameter provided between the turbine wheel back (3) and the cylindrical outer surface and forming an undercut (4).

2. A method for producing a turbine wheel (1), having the following method steps:
- casting a turbine wheel blank (2) having a turbine wheel back (3) and a cup-shaped weld peg (Z) which is integrally formed on the turbine wheel back (3), the cup-shaped weld peg having
  - a cylindrical outer surface having an outer diameter,
  - an end face for mating to a shaft,
  - a cylindrical axial recess,
  - a curved transition region (5) of radially reduced diameter provided between the turbine wheel back (3) and the cylindrical outer surface and forming an undercut (4) in the transition region (5), and wherein the cylindrical outer surface of the cup-shaped cast weld peg (Z) of the turbine wheel blank (2) has a cast diameter greater than the diameter of the curved transition region of radially reduced diameter; and
- machining the generally cylindrical surface of the cast weld peg along a grinding zone to reduce the outer diameter of the cylindrical outer surface of the weld peg to a final weld peg diameter approximately the minimum diameter of the curved transition region.

3. The method as claimed in claim 2, wherein a precision casting process is used as a casting process.

4. The method as claimed in claim 2, wherein the weld peg (4) is machined mechanically in a region (6) which ends before the undercut (4).

5. The method as claimed in claim 4, wherein a grinding process or a turning process is used as a production process.

6. A turbine wheel blank (2) for machining to form a turbine wheel, the turbine wheel blank (2) having:
- a turbine wheel back (3); and
- a cup-shaped weld peg (Z) which is arranged on the turbine wheel back (3), the cup-shaped weld peg having
  - a cylindrical outer surface having an outer diameter,
  - an axial end face adapted for mating to a shaft by friction welding or electron beam welding,
  - a smooth-walled cylindrical axial recess, and
  - a transition region (5) of radially reduced outer diameter provided between the turbine wheel back (3) and the cylindrical outer surface and forming an undercut (4).

* * * * *